US008794944B2

(12) United States Patent
Wagner

(10) Patent No.: US 8,794,944 B2
(45) Date of Patent: Aug. 5, 2014

(54) SCREW SPINDLE MACHINE AND METHOD OF MANUFACTURING THE SAME

(75) Inventor: Peter Wagner, Werdohl (DE)

(73) Assignee: Brinkmann Pumpen K.H. Brinkmann GmbH & Co. KG, Werdohl (DE)

( * ) Notice: Subject to any disclaimer, the term of this patent is extended or adjusted under 35 U.S.C. 154(b) by 142 days.

(21) Appl. No.: 13/394,654

(22) PCT Filed: Sep. 28, 2010

(86) PCT No.: PCT/EP2010/064363

§ 371 (c)(1), (2), (4) Date: Mar. 7, 2012

(87) PCT Pub. No.: WO2011/045179

PCT Pub. Date: Apr. 21, 2011

(65) Prior Publication Data

US 2012/0288395 A1 Nov. 15, 2012

(30) Foreign Application Priority Data

Oct. 14, 2009 (DE) ..... 10 2009 049 311

(51) Int. Cl.

| | |
|---|---|
| ***F01C 21/00*** | (2006.01) |
| ***F03C 2/00*** | (2006.01) |
| ***F03C 4/00*** | (2006.01) |

(52) U.S. Cl.
USPC ..... 418/178; 418/179; 418/196; 418/201.1

(58) Field of Classification Search
USPC ..... 418/178, 179, 196–197, 201.1, 206.1, 418/206.9; 29/888.023
See application file for complete search history.

(56) References Cited

U.S. PATENT DOCUMENTS

| | | | |
|---|---|---|---|
| 3,289,649 | A | 12/1966 | Lamm |
| 3,590,429 | A | 7/1971 | Bammert |
| 6,005,214 | A | 12/1999 | Cramer |
| 8,003,912 | B2 | 8/2011 | Wagner |

FOREIGN PATENT DOCUMENTS

| | | | |
|---|---|---|---|
| AT | 221916 | B | 6/1962 |
| DE | 2559240 | A1 | 7/1977 |
| DE | 69319268 | T2 | 1/1999 |
| WO | 2009012837 | A1 | 1/2009 |

*Primary Examiner* — Theresa Trieu
(74) *Attorney, Agent, or Firm* — Richard M. Goldberg

(57) ABSTRACT

A screw spindle machine having a tubular casing (10) that is made of cast metal and is lined with a wear resistant layer (16), with the wear resistant layer (16) being encapsulated in a steel shell (20) that matches the outer peripheral shape of the layer (16).

4 Claims, 1 Drawing Sheet

SCREW SPINDLE MACHINE AND METHOD OF MANUFACTURING THE SAME

BACKGROUND OF THE INVENTION

The invention relates to a screw spindle machine, e.g. a screw spindle pump or screw spindle compressor, having a tubular casing that is made of cast metal and is internally lined with a wear resistant layer, as well as a method of manufacturing such a screw spindle machine.

WO 2009/012837 A1 discloses a screw spindle pump having an internal cross-section in the shape of three overlapping circles. Thus, the interior of the casing forms three cylindrical chambers arranged side-by-side. The central chamber has a somewhat larger diameter than the two outer chambers and accommodates a main spindle, whereas each of the two outer chambers accommodates a side spindle that is in meshing and fluid-tight engagement with the main spindle. The internal surfaces of the chambers are lined with a wear resistant layer made of electrically conductive SiC, so that the wear caused by the main and the side spindles is reduced. In the manufacturing process, the internal surface of the SiC layer is shaped by means of electro-erosion and then polished by subsequent mechanical finishing, if necessary.

SUMMARY OF THE INVENTION

It is an object of the invention to provide a screw spindle machine that can be manufactured easily and at low costs and the casing of which can withstand larger internal pressures, for given dimensions of the casing.

According to the invention, this object is achieved by the feature that the wear resistant layer is encapsulated in a steel shell that matches the outer periphery of the wear resistant layer.

Since the steel material of the shell has a significantly larger tensile strength than the material of the wear resistant layer, this layer is stabilised by the steel shell so that it can withstand larger internal pressures without forming cracks.

Preferred embodiments of the invention are indicated in the dependent claims.

The wear resistant layer, surrounded by the steel shell, can be mounted in the casing by insert casting or with adhesive. Although the adhesive layer will inevitably have a certain resilience, the steel shell prevents the wear resistant material from expanding by and forming cracks under the high internal pressure.

The invention also relates to a method of manufacturing a screw spindle machine.

In the manufacturing method according to the invention, a hollow body is formed, the wall of which forms the wear resistant layer, and a separate steel shell having an internal contour adapted to the external contour of the hollow body is shrink or press fitted onto the hollow body.

In the shrink fitting process, the steel shell is heated, so that the thermal expansion of the steel results in an increase of the internal cross-section and, consequently, the shell can readily be thrust onto the hollow body. Subsequently, the steel cools down, and the shell shrinks to the external diameter of the hollow body, so that the latter is firmly enclosed in the shell. For cylindrical bodies, the process of mounting a steel tube by thermal shrink fitting is generally known. Surprisingly, it has been shown, however, that this method is also applicable for hollow bodies that have a non-circular external cross-section, without causing damage to the wear resistant material. Although it should be expected that the thermal expansion and shrinkage of the shell changes also the cross-sectional proportions of the shell, so that shrinkage should lead to an uneven strain on the hollow body, it appears that the ductility of the steel assures that the wear resistant layer can nevertheless be firmly encapsulated in the steel shell without damage.

In the press fitting process, the steel shell is produced with a certain dimensional surplus, is thrust onto the hollow body and is then compressed by applying an external pressure, so that it engages tightly around the hollow body. Since the wear resistant layer has high compressive strength, though it has only little tensile strength, high pressures can be applied in the press-fitting process.

BRIEF DESCRIPTION OF THE DRAWINGS

An embodiment example will now be explained in conjunction with the drawings, wherein.

DETAILED DESCRIPTION

Figure 1:
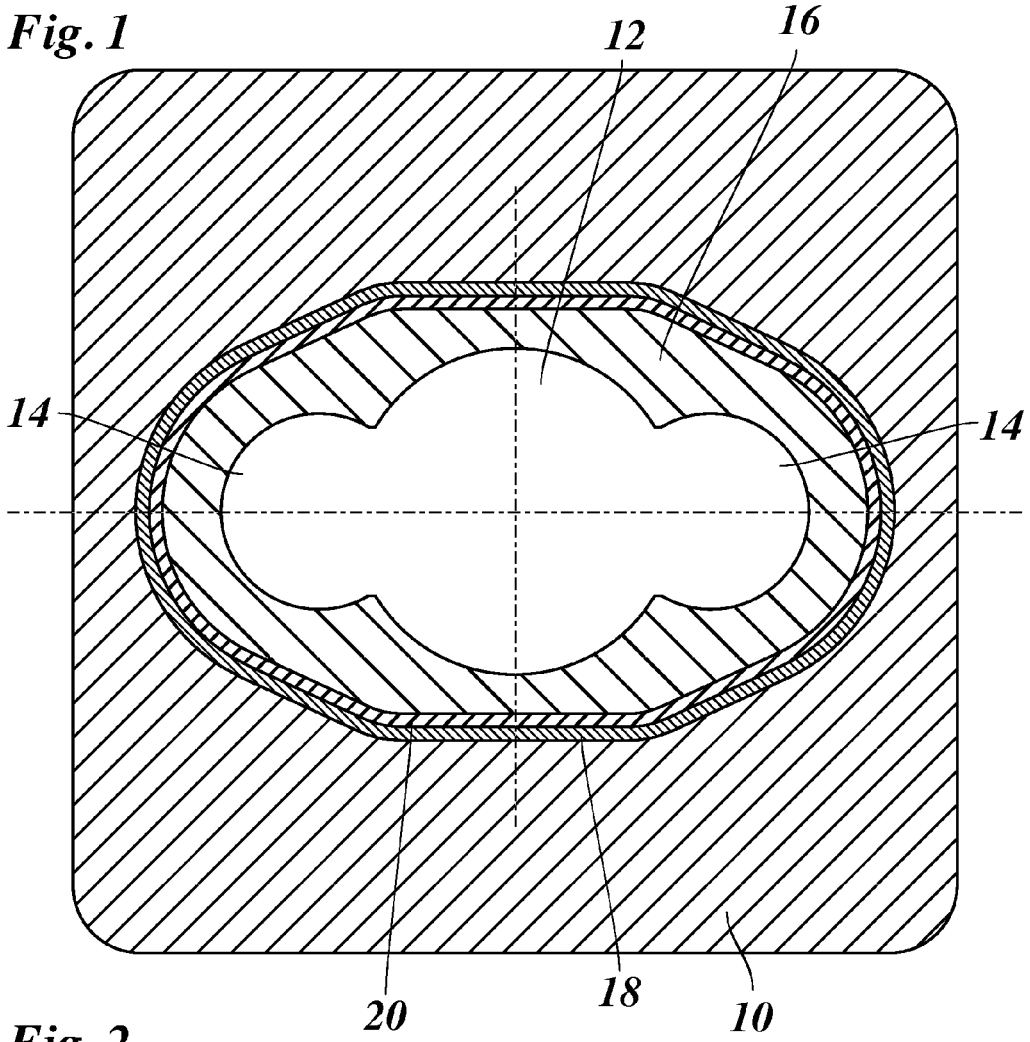
FIG. 1 shows a cross-section of a casing of a screw spindle machine according to the invention.

FIG. 1 shows a tubular casing 10 of a screw spindle machine that is made of cast metal. The cross-section of the cavity in the interior of the casing 10 has the shape of three overlapping circles the centres of which are aligned on a straight line. Thus, the cavity forms a cylindrical central chamber 12 that is intended for accommodating a main spindle (not shown) of the machine, and two cylindrical side chambers 14 that have a somewhat smaller diameter than the central chamber 12 and are each intended for accommodating a side spindle (not shown) of the machine. The side spindles are in fluid-tight meshing engagement with the main spindle, so that, together and with the walls of the chambers 12, 14, they form several fluid-tightly closed volumina that move in axial direction of the casing 10 when the spindles rotate about their respective central axes. Then, the outer peripheral surfaces of the three spindles are in frictional engagement with the internal peripheral surfaces of the chambers 12, 14. For reducing the wear that is caused by this friction, the internal surface of the casing 10 is lined with a layer 16 of a ceramic material. In this example, the ceramic material is silicon carbide (SiC) that has been made electrically conductive by suitable additives. The layer 16 is shaped as a hollow body that is manufactured as a separate insert and is then fixed in the casing by means of an adhesive 18.

When the fluid in the interior of the chambers 12, 14 is compressed to high pressure, the internal surface of the layer 16 is exposed to forces that have a tendency to radially expand the layer 16. Since the relatively brittle material of the layer 16 has only little tensile strength and the adhesive 18 inevitably has a certain resilience, the layer 16 may be expanded and ruptured inside the casing 10. Consequently, if no counter measures are taken, the screw spindle machine as a whole could only withstand a limited maximum fluid pressure.

For this reason, in the screw spindle machine that is proposed here, the wear resistant layer 16 is encapsulated in a steel shell 20 that is shrink-fitted there around. The shell 20 is made of a steel tube that has dimensions and a cross-sectional shape adapted to the external cross section of the layer 16. Preferably, the shell is dimensioned such that it firmly engages the layer 16 on its entire periphery and, preferably is subject to a slight tensile strain, at least at room temperature, so that the layer 16 will still be firmly encapsulated in the shell 20 when the material expands due to heating during operation of the screw spindle machine.

Figure 2:
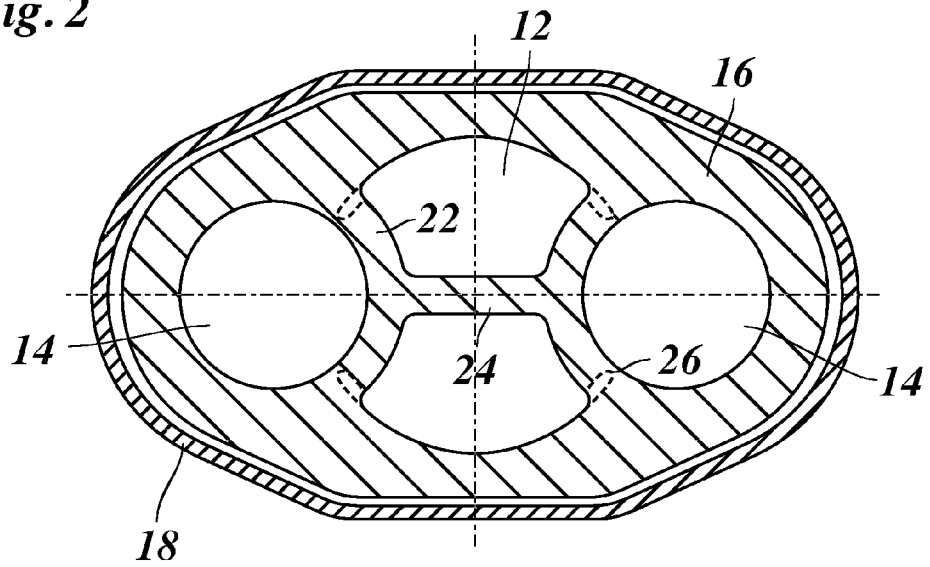
FIG. 2 shows a cross-section of an insert of the casing in a condition in which a steel shell is shrink-fitted thereon.

A decisive step in the process of manufacturing the screw spindle machine has been illustrated in FIG. 2.

Here, the layer 16 still forms a separate hollow body in which the chambers 12, 14 have not yet their final internal contour. Instead, the chambers 14 are still separated from the chamber 12 by lands 22, and the chamber 12 is divided into two part-chambers by a land 24.

As has been described in WO 2009/012837 A1, the layer 16 has initially a too large thickness and a relatively uneven internal surface. In a later step, the internal surface is eroded by electro-erosion, so that one obtains precisely the desired contour of the chambers 12, 14 and the lands 22, 24. In this process, rupture lines 26 may be formed, which facilitate the removal of the lands 22, 24 in a later step.

The shell 20 is initially formed as a separate tube and, in the method that is exemplified here, is heated, so that it expands due to thermal expansion. Then, it is axially thrust onto the hollow body made of SiC. This condition has been shown in FIG. 2. It can be seen that the shell 20, due to its elongated cross-sectional shape, has experienced a larger expansion in the direction of the larger axis of its cross-section (in horizontal direction in FIG. 2) than in the direction orthogonal thereto. When, subsequently, the shell 20 cools down, it shrinks again to and slightly below the external dimension of the layer 16, so that it firmly engages the peripheral surface of the layer 16 and exerts inwardly directed forces onto that layer. In general, these forces will be unevenly distributed over the circumference of the casing, but the tensile ductility of the steel assures that these differences remain within tolerable limits. In the example shown, the lands 22, 24 also contribute to a stabilisation of the layer 16 against the pressure that is exerted by the shell 20 when it is shrink-fitted on the layer 16.

Then, preferably, the layer 16 is finished by means of cylindrical grinding or polishing tools that are successively inserted into each of the chambers 14 and rotated therein. Subsequently, the lands 22, 24 are removed, and, if necessary, the central chamber 12 and the rupture surfaces at the rupture lines 26 are finished as well.

Optionally, the shrink fitting or press fitting of the shell 20 onto the layer 16 may be performed after the chambers 12, 14 have obtained their final shape and surface finish. However, the sequence of steps that has been described above have the advantage that the shell 20 can protect the relatively brittle layer 16 against bursting already during the steps of mechanical finishing.

In a final step, the shell 20 with the layer 16 encapsulated therein is glued into the casing 10.

What is claimed is:

1. A screw spindle machine comprising:

a tubular casing that is made of cast metal;

a wear resistant layer which lines the tubular casing and has an outer peripheral shape; and a steel shell which encapsulates the wear resistant layer and which matches the outer peripheral shape of the wear resistant layer, the steel shell having a form of a one-piece tube.

2. The screw spindle machine according to claim 1, wherein the wear resistant layer, encapsulated in the shell, is fixed in the casing by an adhesive.

3. The screw spindle machine according to claim 1, wherein the wear resistant layer is comprised mainly of SiC.

4. The screw spindle machine according to claim 1, wherein the wear resistant layer includes additives that increase electrical conductivity of the wear resistant layer.

* * * * *